United States Patent [19]

Dufrene

[11] 4,127,297

[45] Nov. 28, 1978

[54] RELEASABLE OVERSHOT

[76] Inventor: Alex Dufrene, P.O. Drawer D, Des Allemands, La. 70030

[21] Appl. No.: 748,109

[22] Filed: Dec. 6, 1976

[51] Int. Cl.[2] ..... E21B 31/00

[52] U.S. Cl. ..... 294/86.2; 294/86.18

[58] Field of Search ..... 294/86.2, 86.12, 86.14, 294/86.17, 86.18, 86.33, 96; 166/99, 136, 137, 214, 215

[56] References Cited

U.S. PATENT DOCUMENTS

| | | | |
|---|---|---|---|
| 1,661,638 | 3/1928 | Spang | 294/86.2 |
| 3,152,829 | 10/1964 | Steele, Sr. | 294/86.18 |
| 3,960,399 | 6/1976 | Dufrene | 294/86.2 |

*Primary Examiner*—James B. Marber
*Attorney, Agent, or Firm*—Donald Gunn

[57] ABSTRACT

A wireline operated overshot is disclosed. In the illustrated embodiment, the overshot includes a grapple which is located internally of a sleeve telescoped about it having a tapered internal shoulder. The grapple engages and disengages a fish. In the event the overshot becomes stuck on a fish, it can be released by downwardly jarring movement which shears a pin. The pin is located to permit a limited range of telescoping movement between the grapple and telescoped external sleeve. A spring is incorporated which forces the grapple downwardly against the tapered sleeve. The apparatus includes a latching mechanism which overcomes the spring to move the parts to a released position.

5 Claims, 5 Drawing Figures

FIG. 3
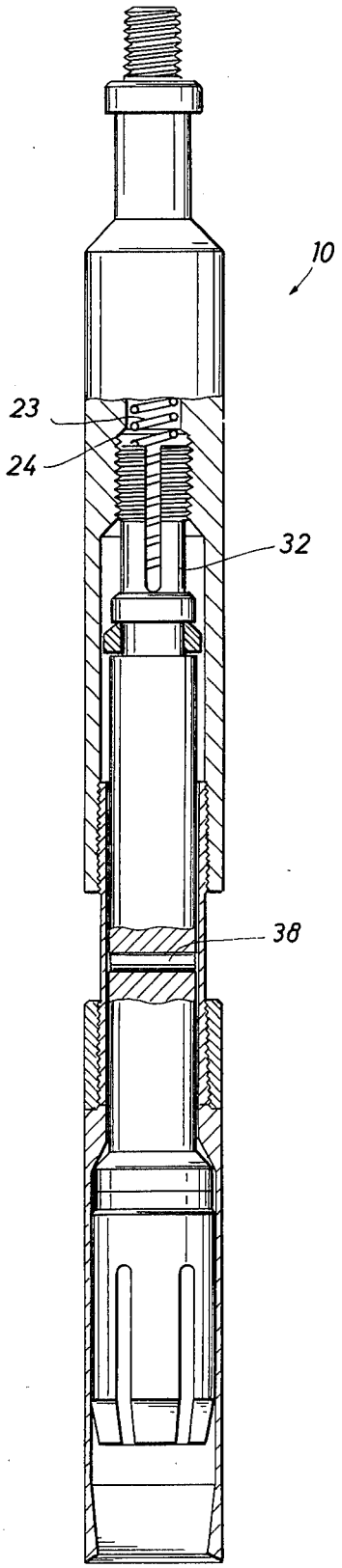
FIG. 4
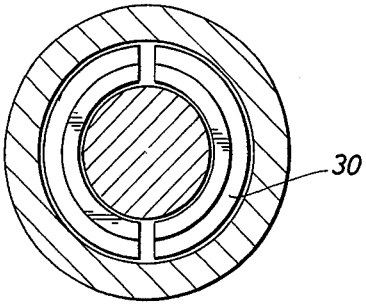
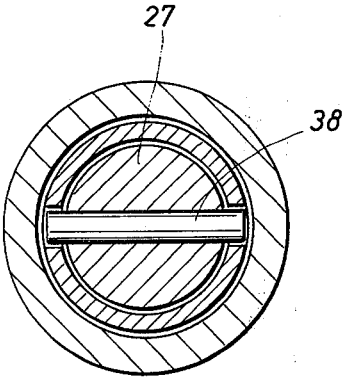
FIG. 5

RELEASABLE OVERSHOT

BACKGROUND OF THE INVENTION

In the operation of producing oil wells, it is necessary from time to time to remove devices from the well. An overshot is normally used for this service. The overshot is normally lowered into the well on a wireline. It is lowered and set down on the item to be lifted or removed. As it is lowered, the overshot surrounds the upper end of the fish to be moved in the well. The fish may be equipped with a conventional or API standard fishing neck. The device of the present invention also will grasp and lift a cylindrical object or the like. In other words, it is able to grasp the exterior of a solid rod or tubular pipe. In any case, it engages the fish and accommodates a variety of shapes.

Occasionally, the fish will be stuck. When a strain is taken on the wireline, it will be determined that the wireline is unable to lift the fish because the fish is stuck for some unknown reason. As a lifting force is applied, it is increased until the breaking point of the wireline is approached. At this juncture if the fish cannot be retrieved, it is necessary to leave the fish in location and retrieve the overshot. In such a circumstance, the present invention comes into play. It incorporates a means which enables a jar to be tripped against the wireline tool. The jar impacts on the overshot. It drives the parts of the overshot in telescoping fashion to a point where the fish is released by the grapple which engages it. Moreover, the overshot incorporates a pin which is sheared intentionally on jarring movement. The jarring movement shears the pin and simultaneously locks the grapple in its most relaxed or released position. When this occurs, the grapple will release anything which is held by it.

This of course avoids lodging the overshot tool in the well attached to the fish, thereby compounding the problem of retrieving the stuck fish. The present invention thus defines an overshot which grasps a fish with a grapple which uses wedging action with the fingers of the grapple to engage the fish and yet which further includes a means enabling the overshot to be disengaged should this be necessary. The jarring movement can be routinely achieved through the use of a jar mechanism, a device readily available.

SUMMARY OF THE PRESENT INVENTION

This invention is summarized as incorporating an upper body or mandrel which is centrally axially drilled. A movable internal body is captured in it. The internal body is forced downardly by a coiled spring. The internal body or mandrel is transversely drilled and receives a pin which is captured in a surrounding external sleeve. The mandrel moves upwardly and downwardly and carries at its lower end a detachable grapple cage which is defined by a set of lengthwise slots and fingers. The several slots and fingers all define a means for grasping the fish. The grapple is surrounded by a telescoping sleeve having an internal tapered surface which forces the grapple fingers toward the fish. The sleeve supports a coupling which surrounds the pin and encloses it, permitting movement. The coupling threads about a tubular extension affixed to the overshot body. The internal mandrel incorporates at its upper end a split, threaded extension. The threads are forced away from a threaded socket on the interior of the overshot body. A coil spring forces the mandrel downwardly or away from the threaded socket. When jarring movement is applied, the pin is sheared, and the inner mandrel is pushed to the upper most position and held there by the internally threaded socket. This holds it in a released position.

DESCRIPTION OF THE DRAWINGS

FIG. 3 is a view similar to FIGS. 1 and 2 showing the shear pin broken to thereby permit the inner mandrel to move to the upper most position upon retrieving the overshot from a stuck fish;

FIG. 4 is a view taken along the line 4—4 of FIG. 1 showing details of construction of a internal lock ring; and FIG. 5 is a sectional view through the shear pin showing its construction and location.

DESCRIPTION OF THE PREFERRED EMBODIMENT

Figure 1:
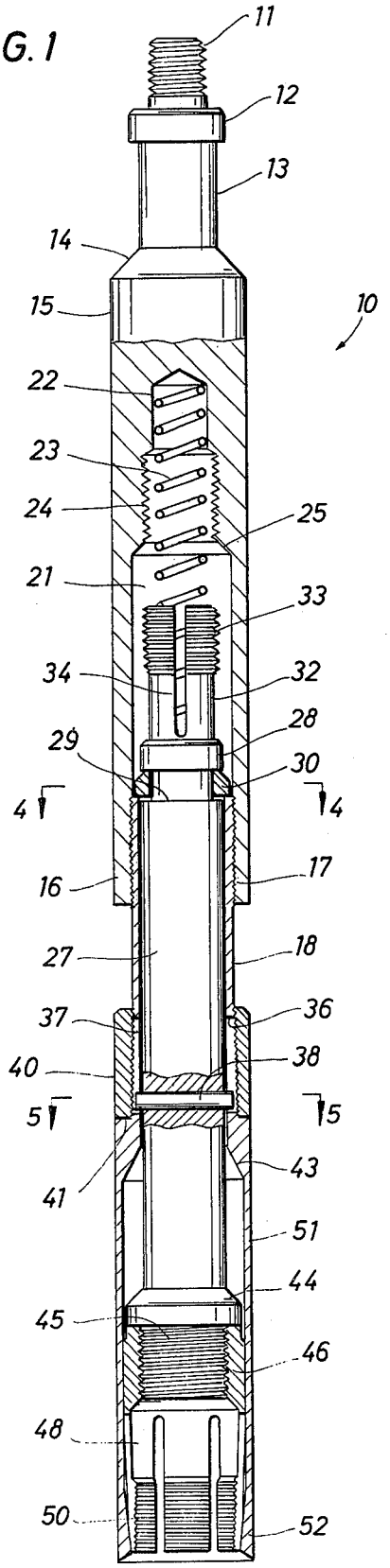
FIG. 1 is a sectional view through the overshot of the present invention disclosing internal details of construction.

In the drawings, the overshot is identified by the numeral 10. The overshot 10 will be described progressing from the top to the bottom end. At the top end, it includes a threaded stub 11 which terminates at an enlarged collar 12. The collar 12 is preferably constructed in accordance with an API standard to enable the overshot to be retrieved by a fishing tool should it be lost in the well. The shoulder 12 is positioned above a neck 13 which is smaller in diameter. The neck 13 extends downwardly to a tapered shoulder 14 where a solid mandrel 15 defines the upper portions of the overshot body. The mandrel 15 is solid, preferably of one piece construction, and is axially drilled as will be described.

Figure 2:
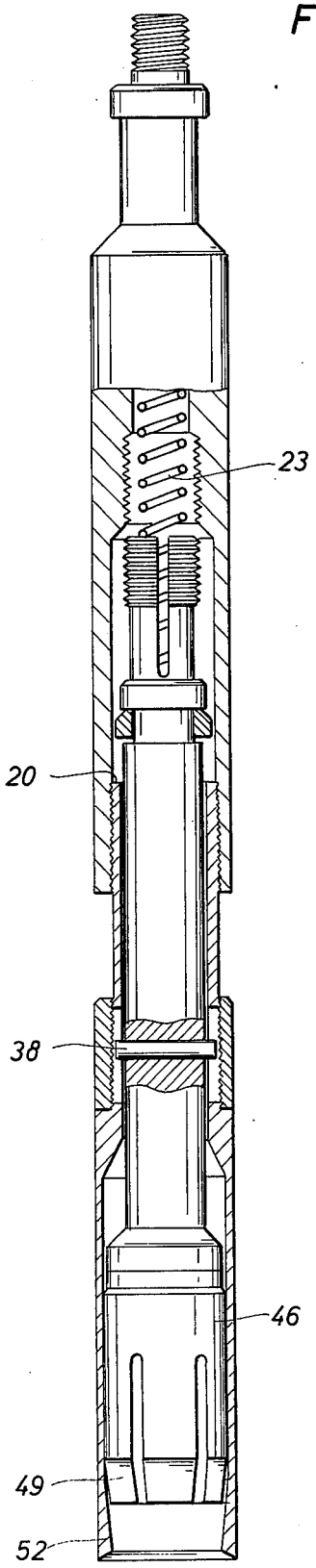
FIG. 2 is a view similar to FIG. 1 showing the grapple raised as will occur on engaging a fish.

The upper tubular body 15 defines an encircling skirt 16 at the lower end. It is internally threaded at 17. This enables the upper threaded end of a sleeve 18 to be joined to the upper body. The sleeve 18 incorporates an internal shoulder 20 which faces upwardly as illustrated in FIG. 2 of the drawings. The function of this shoulder will be set forther later. The upper overshot body is axially drilled to define an internal lengthwise cavity 21. The cavity 21 is drilled to a fairly narrow diameter at its maximum depth, thus defining a small receptacle 22. The receptacle 22 receives a coil spring 23 in it. The coil spring telescopes through an enlarged portion 24 of the cavity. The portion 24 is threaded. It terminates at a lower tapered shoulder 25 which opens into a larger diametric portion. The shoulder 25 is constructed at an angle to serve as a funnel for directing a threaded member into the threads 24. This will be described in detail hereinafter. The shoulder 25 defines the nether opening of the cavity 21, and yet still leaves adequate wall thickness in the surrounding body to withstand the strain taken on the overshot 10.

The overshot body 15 as described to thie juncture is the fixed member. It is adapted to be run in a completed well, typically on a wireline which is affixed to it at the upper end by means of a connector. Quite often, weights will be affixed to the wireline to assure that the tool will run the full length of the well. In addition, an oil operated or mechanical jar may be added. The device functions with the upper body 15 relatively fixed to certain telescoping parts as will be described.

The numeral 27 identifies a movable inner mandrel. The mandrel 27 is formed of solid stock. It includes an enlargement at 28. The encircling enlargement 28 overhangs a shoulder 29. The shoulder 29 which is spaced from the enlargement 28 defines a gap for receiving a split lock ring 30. The ring 30 is sized to lodge against the upper end 20 of the tubular sleeve 18. The tubular sleeve 18 is telescoped around the solid movable mandrel 27. Axial movement is permitted but it is limited by the insertion of the ring 30.

The mandrel 27 supports a circular skirt 32 at its upper end. The skirt 32 is externally threaded at 33. It is sized to thread into the internally threaded receptacle 24. The receptacle 24 has a set of threads which mate with the threads on the skirt 32. The two can be threaded together by relative rotation; however, the skirt 32 is provided with three or four lengthwise splits at 34 which enable the threaded skirt to be jammed into the threaded receptacle. In other words, the lengthwise splits 34 define multiple fingers which deflect radially inwardly to allow the threads 33 to ride over the opposing threads in the receptacle as will be described. The skirt 32, being hollow, receives the coil spring 23 in it which forces the mandrel 27 downwardly.

As described to this juncture, the mandrel 27 telescopes upwardly toward the mandrel 15. It is captured so that it is able to slide axially. When it slides, it is able to move up for a limited distance and thereafter return downwardly as illustrated in FIG. 1 and 2 considered jointly. The downward travel is limited by the lock ring 30. The upward travel is temporary because the spring 23 acts to force the mandrel 27 downwardly. Also, the shear pin stops the upward travel when the spring is compressed. With continued upward travel of the lower mandrel or downward jarring, the pin is sheared, allowing the lower mandrel to ratchet in the released position. As depicted in FIG. 3 of the drawings, the threaded collar 32 is locked in the up position if the mandrel 27 travels upwardly by a sufficient amount. When it does, it locks with the threads.

Returning now to FIG. 1 of the drawings, the sleeve 18 has a pair of opposing slots formed in it at 36 and 37. They are diametrically opposite one another. They have a width which is slightly larger than the diameter of a shear pin 38. The shear pin 38 is pinned through a transverse drilled hole of appropriate size in the mandrel 27. The ends of the shear pin 38 are capped over by a threaded sleeve 40. The sleeve 40 prevents escape of the shear pin. The sleeve 40 threads about the exterior of the sleeve 18. It is rotated and thereby moved upwardly to expose the shear pin for replacement or removal. When it is moved to the lower position, it locks against a shoulder 41 formed on the sleeve 18. The shoulder 41 thus serves as a limit or stop for the threaded sleeve 40. The threaded sleeve 40 is preferably equipped with threads which match the threads at 17 so that it can be threaded on the sleeve 18 prior to connection with the upper mandrel 15.

The sleeve 18 thus includes the relatively thin wall position at the upper end and thereafter it is enlarged in thickness below the shoulder 41. It is axially drilled to receive the inner mandrel 27. The axial passage includes a shoulder at 43 where it is drilled to a larger diameter. The mandrel 27 terminates at its lower end in an enlargement 44. The enlargement 44 is adjacent to an axial threaded sub 45. This enables a grapple cage 46 to be threaded against the shoulder of the enlargement 48. This limits and locates the grapple cage 46. The grapple cage 46 has an upper end which is constructed in the form a spool. It has substantial body and supports a set of internal threads to mate with the threaded sub 45. Additionally, it includes a set of fingers 48 which are defined by lengthwise slots. The slots are evenly spaced to define a set of fingers of preferably equal width. Each finger is smooth on the exterior as better shown in FIGS. 2 and 3 and is cylindrical in shape, but has a slight inward taper at 49. In other words, the several fingers are chamfered when considered as a group. The chamfered fingers are deflected inwardly as will be described. The inside surfaces of the fingers are dressed with a set of serrations 50 which enable the grapple cage to hold and lift a fish. The serrated surface 50 is therefore equipped to grasp, hold and retain a fish.

Going now to the outer sleeve, it has a relatively thin wall at 51 below the shoulder 43. The thin wall is fairly uniform and thickness. The outside dimension is uniform to the bottom end of the tool. The wall, however, is slightly thickened at 52 to define an internally tapered surface. The surface is located immediately adjacent to the fingers of the grapple cage 46. This tapered surface forces the fingers inwardly. When the fingers are forced inwardly, they more readily grasp a fish. This is in part dependent on the angle of the bowl 52 which surrounds the fingers, it being observed that the bowl has a tapered length greater than the length of the chamfered surface 49 which faces it on the multiple fingers. Accordingly, the bowl wedges the collet fingers into a grasping position.

The operation of the overshot will now be described where its advantages will be set forth. FIG. 1 shows the overshot prior to use. It is run into a well until it is positioned against a fish equipped with either a fishing neck or a stub projection of appropriate size. The fish enters the grapple cage 46. As the fish enters, it forces the grapple cage upwardly because the fingers obstruct the opening and they are held in the obstructive position by the tapered bowl which surrounds the fingers. In other words, the fish forces the grapple bowl upwardly, and with it, the inner mandrel 27. This movement is accomplished and compresses the spring 23. This movement, of course, depends on placing adequate weight on the overshot 10, either from its own weight or through the weight of sinker bars affixed to it, to overcome the spring and thereby force the grapple cage upwardly.

Upward movement of the grapple cage is accompanied by outward deflection of the fingers as they slide away from the tapered bowl 52. This enables the fingers to flex outwardly and thereby enlarge the opening of the grapple cage. This permits the fish to enter into the overshot as deeply as permitted. The extent to which the fish enters is in some ways limited by the construction of the fish such as large protruding external shoulders and the like. In any event, it enters to a substantial depth although it is not necessary that the fish extend through the full length of the grapple cage to about the threaded sub 45. The grapple cage is thus moved upwardly as shown in FIG. 2. It will be observed in FIG. 2 that the grapple cage moves upwardly but it does not move to the point that the inner mandrel is locked to the upper mandrel. The relative axial movement is shown in FIGS. 1 and 2 compared with one another.

The overshot at this juncture is then lifted. When it is lifted, the grapple cage remains relatively fixed about the fish while the coil spring 23 adjusts the relative position of the tapered bowl 52 about the grapple cage. In other words, the upward movement on the overshot raises the outer telescoped sleeve 18 which surrounds the grapple cage and permits extension of the spring 23 back toward the condition of the components shown in FIG. 1. Such movement forces the grapple snuggly against the fish. This is accomplished by jamming the fingers of the grapple cage toward the fish. This grasps the fish and enables it to be retrieved with the overshot.

It will sometimes occur that the fish is stuck. When it is stuck, it is necessary then to retrieve the overshot. If the overshot grasps the fish without any means of release, it will then become necessary to break the wireline supporting the overshot, and this of course compounds the fishing job. To avoid this undesired result, the present invention is particularly adapted to selectively shear a pin and lock in the up position to enable release of the fish. The dimensions of the grapple and bowl are such that, if they are able to engage a fish, they are subsequently able to release it in the same manner.

Should the fish be stuck and the overshot 10 latched firmly to it, the release procedure is as follows. Heavy jarring on the tool forces the inner mandrel down against the fish. The jarring, however, provides inertial upset which drives the upper mandrel further downwardly. This compresses the spring 23, shears the pin and drives the threads 33 of the skirt 32 into the threaded receptacle 24. The receptacle 24 is able to receive the threaded skirt wiithout rotation becuase it is constructed of thin fingers which deflect inwardly. When the fingers deflect inwardly, they ratchet over the threads. It therefore jams the inner mandrel 27 in the uppermost position. This is accomplished only by shearing the pin 38 as shown in FIG. 3. It is sheared when it travels beyond the ends of the lengthwise slots 36 and 37 which accommodate the tips of the pin. In the position of FIG. 3, the grapple cage is in the upper most position and is maintained there, no longer free to move downwardly. The pin is sheared whereupon the upward movement is completed. The fingers and opposing serrations on them ratchet upward to the position of FIG. 3. The pin is easily replaced by rotation of the threaded member around it. The mandrel 27 is moved down from the locked position by unthreading it. This is easily done by forming an Allen wrench opening in the bottom of the threaded sub 45 and rotating with an Allen wrench until the unthreading is completed.

The foregoing is directed to the preferred embodiment but the scope of the present invention is determined by the claims which follow.

I claim:

1. An overshot comprising (a) an elongate body having an extended circular skirt affixed to one end thereof;

(b) a grapple formed of multiple fingers inside said skirt and having a set of serrations for grasping a fish which fingers deflect inwardly and outwardly dependent on their relative longitudinal position adjacent to said skirt;

(c) a movable mandrel attached to said grapple axially received within said body;

(d) resilient force means coacting with said mandrel and said body to force said grapple into a fish engaging position relative to said skirt;

(e) means for releasably locking said grapple in a fish releasing position relative to said skirt;

(f) a shear pin joining said body and said mandrel together;

(g) inertial upset locking means which comprises an internally threaded opening in said body and a ratchet means attached to the upper end of said mandrel aligned with and remote from said threaded opening which is held in the separated position by said resilient force means and which ratchet means comprises a set of fingers spaced in a circle which collectively have serrations on the exterior thereof, and said fingers deflect radially, and wherein the opening of said body is adjacent to a funnel-shaped shoulder to guide said fingers into said opening; and (h) first and second slots formed in said skirt above a thickened lower end to deflect said grapple, said slots receiving the ends of said shear pin which passes through said mandrel to freely permit a limited range of axial movement by said mandrel.

2. The apparatus of claim 1 including a chamfered outer face on said grapple at the lower end thereof, said grapple deflecting inwardly by contact of said chamfered face against the thickened lower end of said skirt.

3. The apparatus of claim 2 including evenly spaced slots in said grapple defining similar deflectable fingers.

4. The apparatus of claim 3 including a threaded detachable thimble device supporting said grapple.

5. The apparatus of claim 4 including a projecting threaded sub affixed to said mandrel for attaching said grapple thimble to said mandrel.

* * * * *